US005099708A

United States Patent [19]

Chung

[11] Patent Number: 5,099,708

[45] Date of Patent: Mar. 31, 1992

[54] ADJUSTABLE ROLLING CAM SLIDER

[76] Inventor: Ming-Chin Chung, No. 13-1, Lin 29, Jui Tang Li, Yangmei Town, Taoyuan Hsien, Taiwan

[21] Appl. No.: 698,130

[22] Filed: May 10, 1991

[51] Int. Cl.[5] ..... B26D 5/08

[52] U.S. Cl. ..... 74/110; 83/527; 83/588; 83/632; 83/635

[58] Field of Search ..... 83/632, 626, 527, 630, 83/627, 588, 188, 191, 634, 635; 74/110

[56] References Cited

U.S. PATENT DOCUMENTS

| | | | |
|---|---|---|---|
| 1,025,016 | 4/1912 | Parfitt | 83/632 X |
| 1,276,437 | 8/1918 | Stevenson | 83/630 X |
| 3,541,909 | 11/1970 | Franzen | 83/635 X |
| 3,821,890 | 7/1974 | Dewey | 83/634 X |

*Primary Examiner*—Frank T. Yost

*Assistant Examiner*—Kenneth E. Peterson

*Attorney, Agent, or Firm*—Bacon & Thomas

[57] ABSTRACT

An adjustable rolling cam slider which has a cam sliding block displacing vertically to link with a horizontal sliding block by two ball joints, and a link with a fixing block to get in touch with and drive the cam sliding block to displace downward, consequently cause the horizontal sliding block to slide horizontally upon lowering of the main shaft of the punching press. Steel balls are used between the sliding block and sliding rail of a sliding device for rolling of the horizontal sliding block, and two buffer reset devices are designed each with a spring which can have its degree of compression adjusted to adjust the acting angle between the cam sliding block and the horizontal sliding block for adjustment of acting force and stroke to form a cam slider which can convert vertical action of punching machine to horizontal action.

4 Claims, 5 Drawing Sheets

ADJUSTABLE ROLLING CAM SLIDER

BACKGROUND OF THE INVENTION

The conventional cam slider, as shown in FIG. 1, is mainly used on punching machine to convert vertical action to horizontal action. In other words, it converts vertical force to horizontal force for lateral punching and precise machining. In general the conventional cam slider is comprised of a first sliding block (1) and a second sliding block (2) perpendicular to each other with a first 45 degree slant face (11) on the first sliding block (1) and a second 45 degree slant face (21) on the second sliding block (2) so that when the punching machine is operated to get a vertical action, the first slant face (11) and the second slant face (21) are displacing each other so that the second sliding block (2) is displaced leftward horizontally to convert the vertical force to horizontal force. Such a conventional structure of cam slider has some defects, as follows:

(1) The first sliding block and the second sliding block are displaced by each other through contact of the first and second slant faces, which means a large friction and consequently occurrence of significant wear and a large loss of acting force;

(2) The resulted horizontal stroke depends on the length of the slant face, adjustment of stroke is not possible. That is, it is necessary to remove and replace the sliding blocks with that having slant faces of other length, or replace with other cam slider for adjustment of stroke.

(3) The resulted acting force depends on the displacement of the slant faces, replacement of the sliding blocks is required for change of stroke, and hence it is not easy to adjust acting force.

(4) The slant faces are impacting each other for displacement, and hence significant wear on the slant faces occurs, and such impact may damage machine and shorten its service life.

SUMMARY OF THE INVENTION

The present invention relates to an adjustable rolling cam slider, particularly a cam slider to convert vertical action of punching machine to horizontal action. It comprises a base with sliding device, vertical rails, cam sliding block, cam stop, buffer reset devices and link on it. The cam sliding block is displacing vertically and linking with a horizontal sliding block by two pivot joints, and the link with a fixing block gets in touch with and drives the cam sliding block to displace downward, consequently causes the horizontal sliding block to slide horizontally upon lowering of the main shaft of the punching press so as to convert vertical action to horizontal action. Two buffer reset devices are designed each with a spring to return the cam sliding block and the horizontal block to their respectively beginning positions at end of each punching cycle by tension and the spring, and the spring can have its degree of compression adjusted to adjust the acting angle between the cam sliding block and the horizontal sliding block for adjustment of acting force and stroke to form a cam slider which can convert vertical action of punching machine to horizontal action.

DESCRIPTION OF THE PREFERRED EMBODIMENT

The present invention is described below with reference to the attached drawing.

Figure 1:
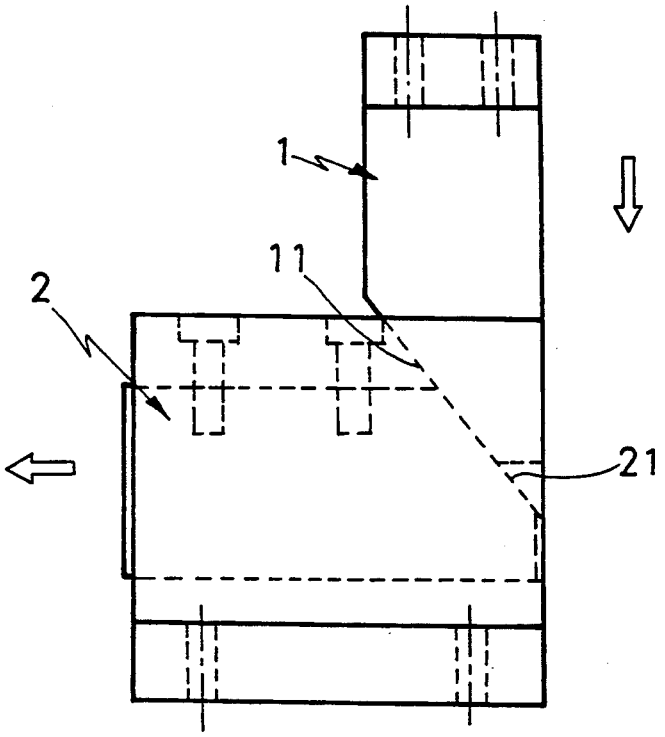
PRIOR ART FIG. 1
FIG. 1 illustrates the structure and operation of a conventional cam slider.
Figure 2:
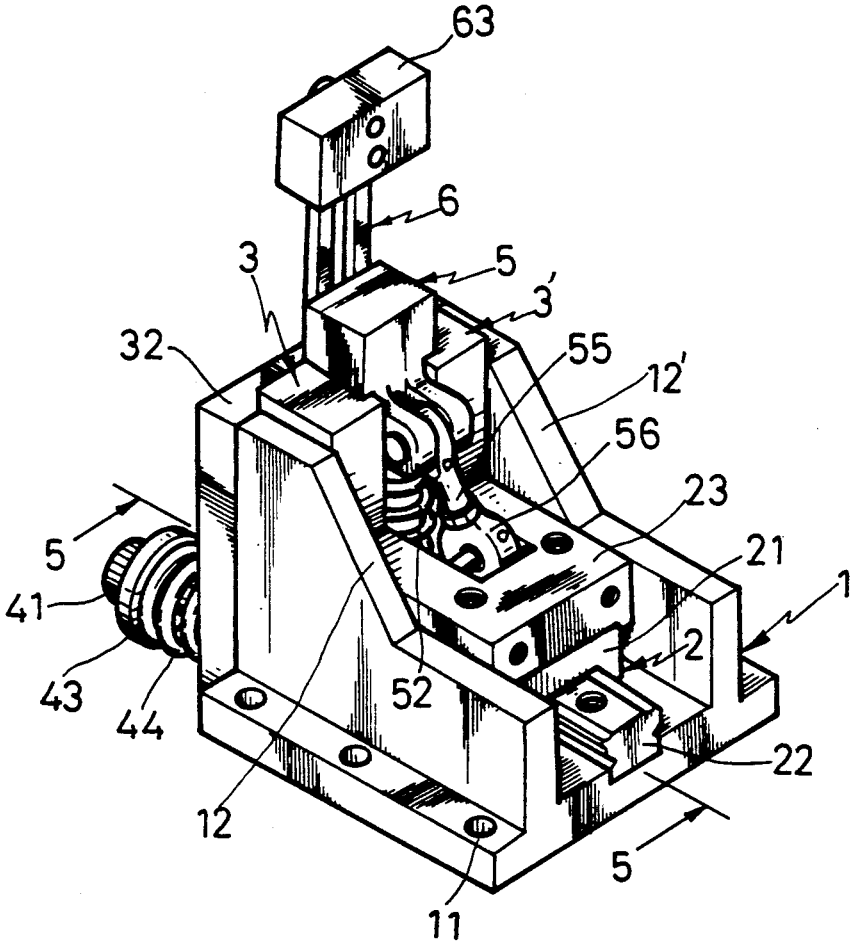
FIG. 2 is a perspective view of an embodiment according to the present invention.
Figure 3:
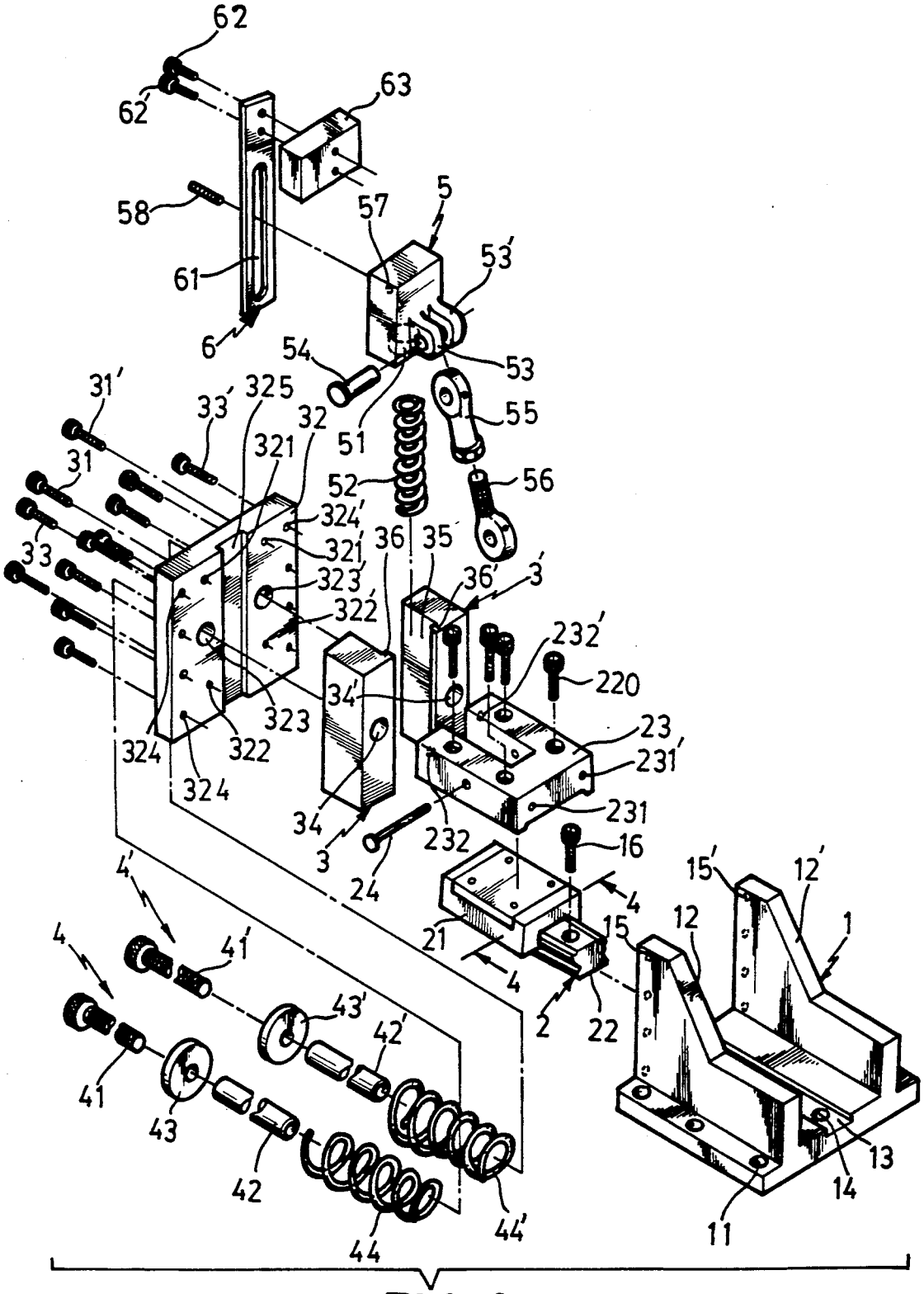
FIG. 3 is another perspective view of the embodiment according to the present invention.
Figure 4:
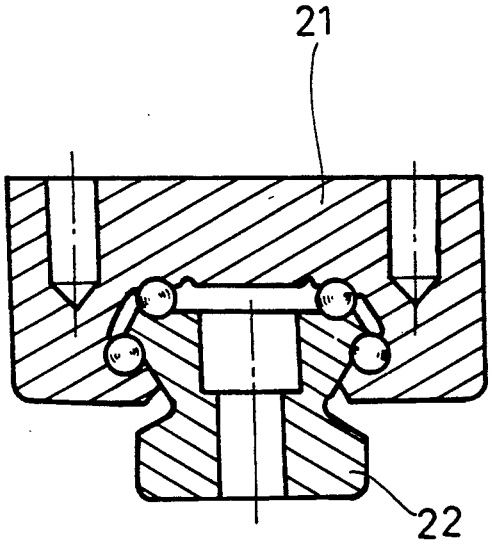
FIG. 4 is a cross sectional view taken along the line 4—4 in FIG. 3.

As shown in FIGS. 2 and 3, the present invention has a base (1) with a plurality of positioning holes (11) at its two lateral sides for fixing the base (1) on working table on any punching machine. Two parallel perpendicular struts (12 and 12') are extending outward from the base (1), a recession (13) and a screw hole (14) are designed on the base (1) at such appropriate positions between the struts (12 and 12') to fix a sliding device (2) at the recession (13) by means of a bolt (16). The sliding device (2) is comprised of a rolling block (21) and a rolling rail (22) which will not be described here for they are conventional structure and they are not within the scope of claim herein. A horizontal sliding block (23) is incorporated with the rolling block (21) by means of a bolt (220), and the horizontal sliding block (23) has two screw holes (231 and 231') at the front end for installation of punching tool, and two positioning screw holes (232 and 232') at the rear end for connection of two positioning screw rods (41 and 41') from two buffer reset devices (4 and 4'). At the back of the sliding device (2) two vertical rails (3 and 3') are fixed to a cam stop (32) by means of two bolts (31 and 31') through the holes (321 and 321') and the holes (322 and 322') at the inner sides of the cam stop (32). The positioning screw rods (41 and 41') of the buffer reset device (4 and 4') at the back of the cam stop (32) are each incorporated with a sleeve (42 or 42') to pass through the hole (323 or 323') at the cam stop (32) and the hole (34 or 34') of a vertical rail (3 or 3'), and then they are secured in a positioning screw hole (232 or 232') of the horizontal sliding block (23). The cam stop (32) are secured at the positioning screw holes (15 and 15') at the back of the struts (12 and 12') of the base (1) by means of bolts (33 and 33') through the holes (324 and 324') at the cam stop (32). Each of the buffer reset devices (4 and 4') has a positioning screw rod (41 or 41') incorporating with a stop ring (43 or 43'), a sleeve (42 or 42') and a spring (44 and 44') in order. These positioning screw rods (41 and 41') pass through the cam stop (32) and the vertical rails (3 and 3') for fixing to the horizontal sliding block (23) in a manner that the front end and rear end of each spring (44 or 44') are retained between the cam stop (32) and a stop element (43 or 43'). A sliding channel (35) is formed between the vertical rails (3 and 3') with two stop strips (36 and 36') for installation of a cam sliding block (5). The cam sliding block (5) has a slot (51) at the bottom for holding of a spring (52), and two projecting elements (53 and 53') at the front side to connect to a pivot joint (55) and then secure to another pivot joint (56) which is connecting to the horizontal sliding block (23) by means of a positioning pin (24) so that the cam sliding block (5) is linking with the horizontal block (23) through the pivot joints (55 and 56). A link (6) is designed within a channel (325) on the cam stop (32) at the back of the cam sliding block (5). The link (6) has a guide slot (61) so that a guide rod (58) from a screw hole (57) at the back of the cam sliding block (5) cam slidably move in the guide slot. The upper end of the link (6) is incorporated with a fixing block (63) by means of two bolts (62 and 62').

Figure 5:
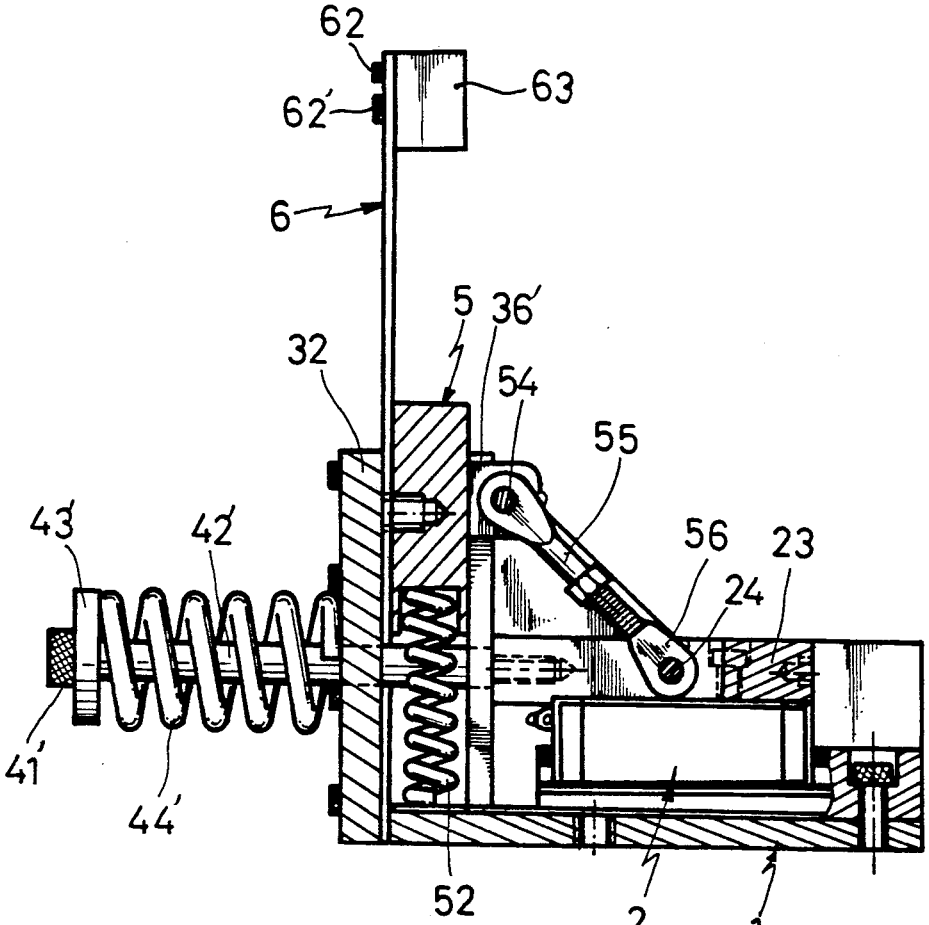
FIG. 5 is a cross sectional view (A) taken along the line 5—5 in FIG. 2.
Figure 6:
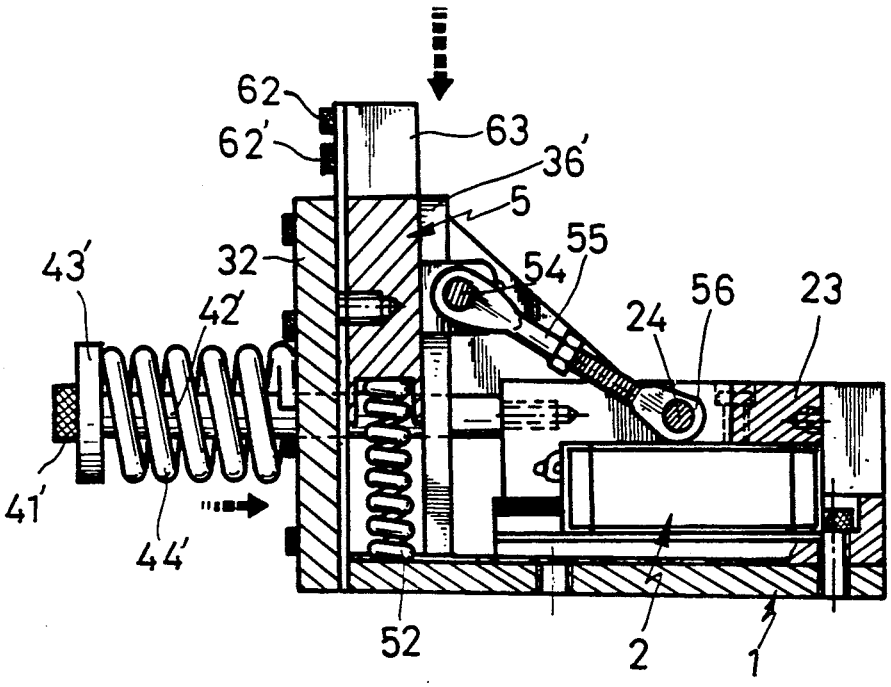
FIG. 6 is a cross sectional view (B) taken along the line 5—5 in FIG. 2.

With reference to the embodiment described above, the operation and characteristics of the present invention are described below:

As shown in FIGS. 5 and 6, the fixing block (63) on the top of the link (6) is connecting to the main shaft of the punching machine. As soon as the main shaft is moving downward, the fixing block (63) brings the link (6) to displace downward, and consequently the fixing block (63) gets in touch of, and force the cam sliding block (5) to displace downward with the spring (52) below it as a buffer by compression. Through linking by the two pivot joints (55 and 56), the cam sliding block (5) drives the horizontal sliding block (23) to slide horizontally on the sliding device (2) so that the vertical action of the punching machine is converted to horizontal action for lateral punching and precise machining. At the end of the vertical movement of the cam sliding block (5) and the horizontal movement of the horizontal sliding block (23), the cam sliding block (5) and the horizontal sliding bloc269 returning to their respective original positions automatically by tension of the spring (52) and the springs (44 and 44') of the buffer reset devices (4 and 4') which are compressed during such movements.

The present invention has the following features:

(1) Adjustable Stroke: As shown in FIGS. 5 and 6, the two pivot joints (55 and 56) are connected together with a threaded rod to permit easy and fast adjustment of the stroke of the cam sliding block (5) and the horizontal sliding block (23).

(2) Adjustable Acting Angle: The acting angle according to the present invention is adjustable within a range of 10 to 40 degrees to meet the need of stroke or acting direction. The smaller the acting angle, the greater the acting force. The acting angle and the acting force can be adjusted by adjustment of the compression of the springs at the buffer reset devices (4 and 4') behind the cam stop (32), or by using of tool of different length on the horizontal sliding block (23). Adjustment of acting angle and acting force according to the present invention is easy.

(3) Standardized Specifications: The present invention can be embodied in different specifications for punching of different working pieces of different break strengths at different punching machines.

(4) Easy and Fast Installation: The present invention is embodied as an assembly which can be installed with tool and placed on punching machine directly for lateral punching and precise machining by converting vertical punching action to horizontal punching action.

(5) Transmission via Linking: As shown in FIGS. 5 and 6, the vertical acting force from the punching machine is converted to horizontal acting force by transmission from the cam sliding block (5) to the horizontal sliding block (23) through two pivot joints (55 and 56), and tool can be installed on the horizontal sliding block (23) directly. With such a transmission via linking, a horizontal acting force of greater than the punching force exerted by the punching machine is available at an acting degree of less than 45 degree, and the smaller the acting angle, the greater then acting force.

(6) Easy Part Replacement: Simple structure and assembly permit use of standardized parts, and make procurement and replacement of parts easy.

(7) Rolling Contact for Long Service Life: The horizontal sliding block is rolling on a number of steel balls placed between the sliding block and the sliding rail for the minimum wear and the longest service life.

I claim:

1. An adjustable rolling cam slider comprising a base with a plurality of positioning holes at two lateral sides for installing on a working table of a punching machine, two parallel struts extending upward from the base with a plurality of screw holes at a rear end of said struts, and a recession accompanied with a screw hole at a bottom of said base for fixing of a sliding device by means of a bolt;

said sliding device comprising a rolling block and a sliding rail with a fixing hole for fixing said sliding rail to the recession in the base by means of a bolt, designed in a way that the rolling block is incorporated with a horizontal sliding block by means of a bolt, the horizontal sliding block has a front end and a rear end and a plurality of screw holes at the front end for installation of a punching tool, and two positioning holes at the rear end for connecting to a buffer reset device;

two vertical rails located adjacent the sliding device, having a plurality of screw holes at a back of each vertical rail for fixing to a cam stop, a stop strip at a side of each vertical rail, forming a sliding channel between them for placement of a cam sliding block;

a cam sliding block having a slot in its bottom for installation of a cam sliding block spring, and two projecting elements for installation of two ball joints between them positioned by positioning pins;

two pivot joints, one of them is fixed to the cam sliding block with a pin, and the other to the horizontal sliding block on the sliding device with a positioning pin, said joints are connected together by an adjustable threaded rod in order to link the cam sliding block with the sliding device;

a cam stop in the form of a plate having a middle, outer edges and two rows of equidistant bolts holes at each side arranged symmetrically, said cam stop also having two sleeve holes in the middle between an upper one and a lower one of said bolt holes, and there is a channel in the middle of the cam stop, and the cam stop is secured to the rear ends of the struts of the base by bolts passing through the bolt holes in the outer edges of the cam stop;

two buffer reset devices having a positioning screw rod incorporated with a stop ring, a sleeve and a buffer spring in order positioned in a manner than the positioning screw rod is passing through the sleeve holes of the cam stop and the vertical rail for fixing to the horizontal sliding block; and a link located between the channel in the cam stop and the cam sliding block, designed with a guide slot for sliding of a guide rod at the back of the cam sliding block, and having a top and a fixing block fixed to its top by means of a bolt for connecting to a main shaft of said punching machine;

characterized by the assembly of the aforesaid components on the base so that a lower displacement of the main shaft of the punching machine can cause the fixing block attached to the link to move downward and then get in touch with and force the cam sliding block to displace downward, and consequently by linkage through the two pivot joints, the horizontal sliding block on the sliding device is slid horizontally for converting the vertical action of the punching machine to horizontal action; the rolling block is rolling on the sliding rail by use of a plurality of steel balls between the rolling block and sliding rail of the sliding device; and the adjustable threaded rod connecting the two pivot joints for adjustment of acting force for precise lateral punching and machining.

2. An adjusting rolling cam slider as claimed in claim 1 wherein the cam sliding block and the horizontal sliding block are connected by two pivot joints in an adjustable angle which can be adjusted by adjustment of the degree of compression of the buffer springs of the two buffer reset devices for adjustment of acting force which is reservedly proportional to the size of an angle between the threaded rod and the base.

3. An adjustable rolling cam slider as claimed in claim 1 herein each of the buffer reset devices has a positioning screw rod passing through the cam stop and the cam sliding block to connect to the horizontal sliding block, and said buffer spring is retained and compressed between the stop ring and the cam stop while the cam sliding block spring is at the bottom of the cam sliding block so that the cam sliding block is linking with the horizontal sliding block for converting vertical action to horizontal sliding, and the compression of the two said springs can return the cam sliding block and the horizontal sliding block to a beginning position at an end of each punching cycle by tension of said springs.

4. An adjustable rolling cam slider as claimed in claim 1 wherein the link has a guide slot corresponding to the guide rod of the cam sliding block so that the fixing block on the link can maintain its vertical displacement while the link is moving in the channel on the cam stop.

* * * * *